US005676241A

United States Patent [19]

Degoix et al.

[11] Patent Number: 5,676,241

[45] Date of Patent: Oct. 14, 1997

[54] HOLDER FOR PLURAL AMMUNITION MAGAZINES

[75] Inventors: Christophe Degoix, Argenteuil, France; Gary A. Sniezak, Columbia; Kevin Langevin, Camden, both of S.C.

[73] Assignee: FN Manufacturing, Inc., Columbia, S.C.

[21] Appl. No.: 658,354

[22] Filed: Jun. 5, 1996

Related U.S. Application Data

[60] Provisional application No. 60/001227, Jul. 19, 1995.

[51] Int. Cl.[6] ..... B65D 85/00; F42B 39/26

[52] U.S. Cl. ..... 206/3; 220/533

[58] Field of Search ..... 42/53, 87, 88, 42/90; 89/34; 206/3, 317; 220/555, 532, 533

[56] References Cited

U.S. PATENT DOCUMENTS

| | | | |
|---|---|---|---|
| 3,463,343 | 8/1969 | Asenbauer | 220/532 |
| 3,976,193 | 8/1976 | Dogliotti | 220/555 |
| 5,319,872 | 6/1994 | Bammate | 206/3 |

*Primary Examiner*—Jimmy G. Foster
*Attorney, Agent, or Firm*—Michael A. Mann, P.A.

[57] ABSTRACT

A device for holding two ammunition magazines in spaced relations so that either can be inserted into the magazine well of an M-16 rifle, an M-4 carbine, or an M-249 machine gun without interference with the operation of the weapon from the remaining magazine. The device comprises a shell and a centerpiece. The shell holds the two magazines in a tapered or "V" shaped arrangement, and the centerpiece, acting in combination with the shell, secures the magazines in place. The device is made of a light-weight corrosion and chemical resistant polymer. In an alternative embodiment, the magazines are held in an approximately parallel position within the shell.

18 Claims, 3 Drawing Sheets

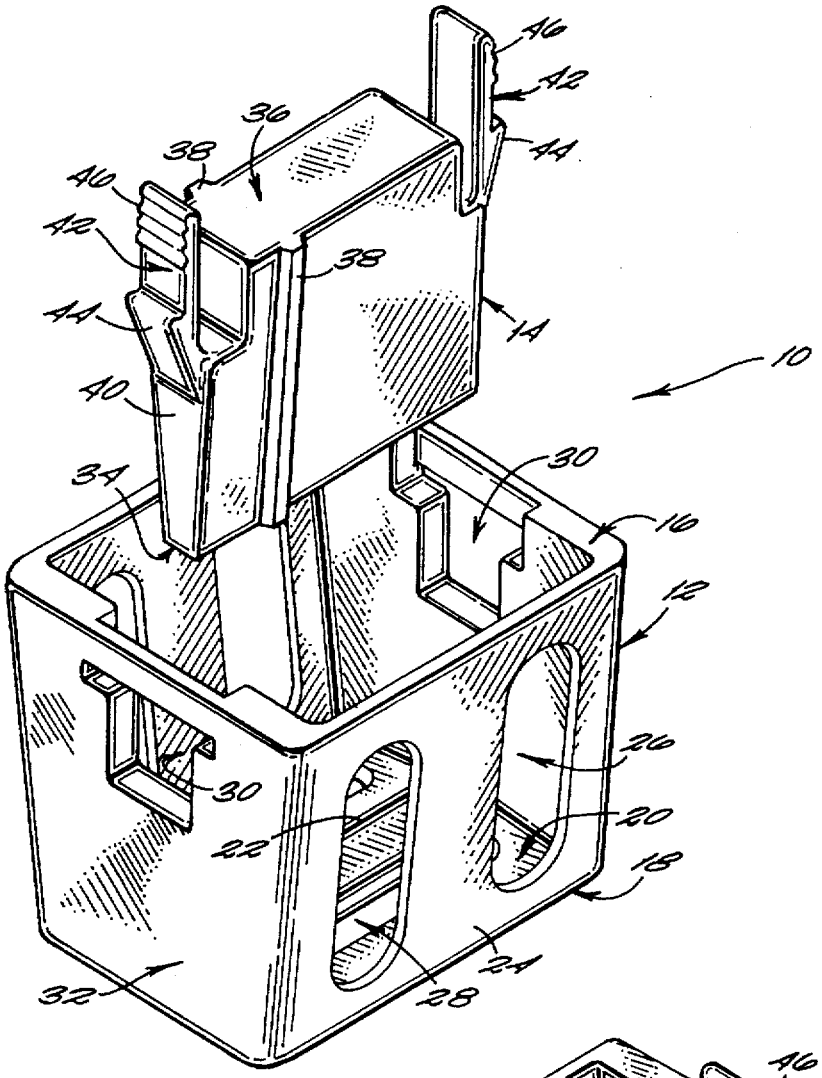
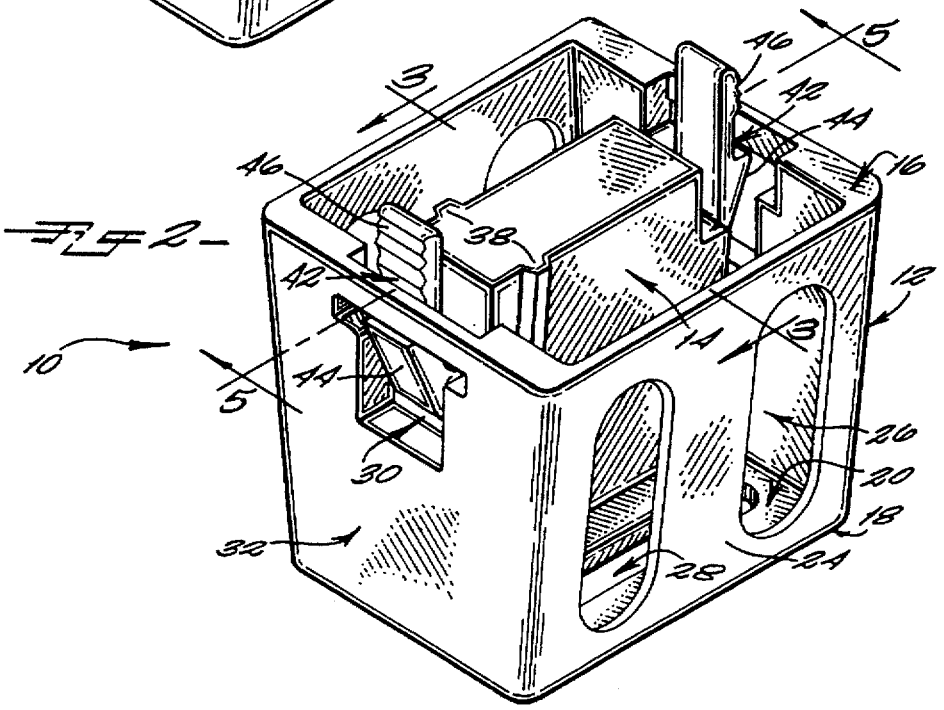
FIG 2

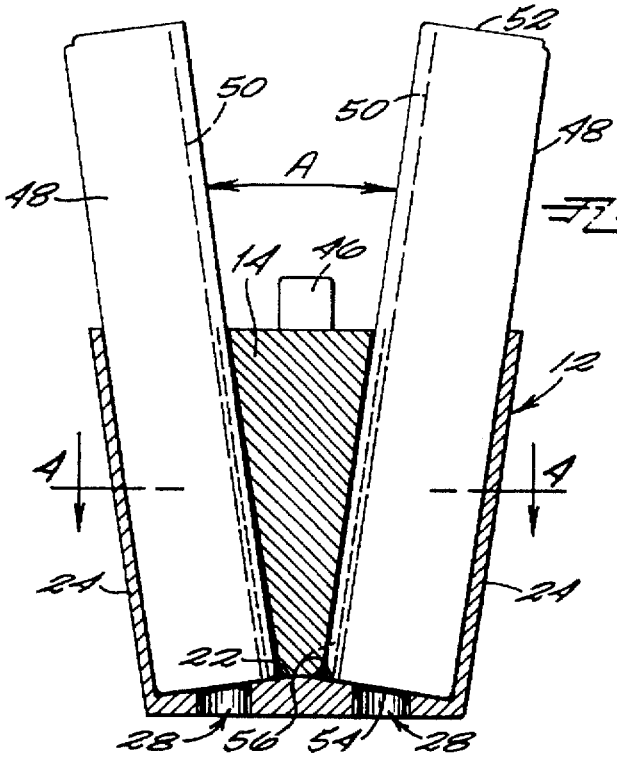
FIG 3
FIG 4
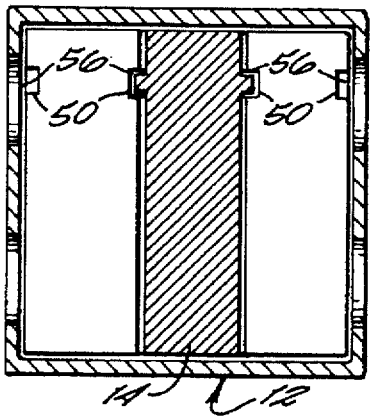
FIG 5
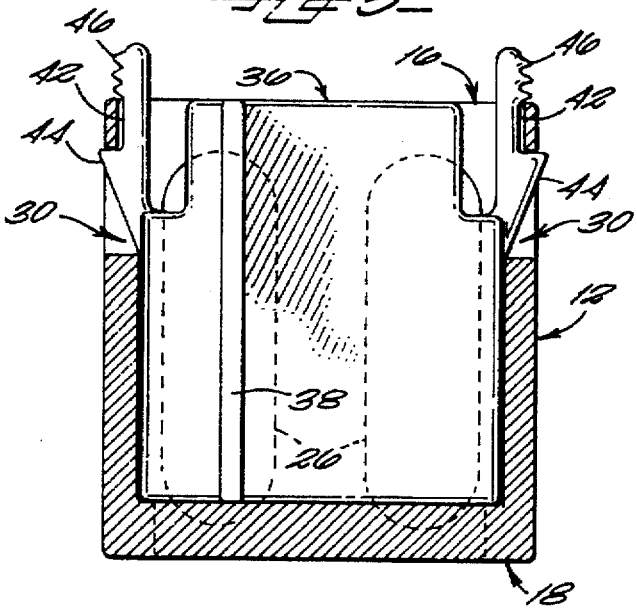

HOLDER FOR PLURAL AMMUNITION MAGAZINES

This application claims the benefit of U.S. Provisional Application No. 60/001,227 filed Jul. 19, 1995.

BACKGROUND OF THE INVENTION

1. Field of the Invention

The present invention is generally related to magazines for holding cartridges for rifles. In particular, the present invention is a device for holding two magazines of cartridges so that either magazine can be inserted into the magazine well of a rifle, while the other magazine continues to be held at the ready by the device.

2. Discussion of Background

Rifles such as the M-16 and the M-4 carbine are capable of firing rounds of ammunition rapidly. In combat, having a large supply of ammunition ready to fire on command, whether the rounds are fired individually, in bursts of three rounds, or continuously in a fully automatic mode, may be essential for suppressing enemy fire or overwhelming an enemy position. During the reloading of these types of weapons, the soldier is exposed to enemy fire and depends on others in his unit to continue firing their weapons until his is reloaded. Coordination of firing by the members of a unit so that all are not reloading at the same time is part of standard military training.

Reloading involves pressing a magazine release button on the side of the magazine well of the rifle to release the magazine, pulling the magazine clear of the magazine well, storing it for reuse later, grasping a new magazine with cartridges in it, inserting the new magazine into the lower magazine well until it clicks into place, and then chambering a cartridge from the new magazine. The time required for reloading can be reduced by practice.

There are both 20- and 30-round magazines for combat rifles. In combat, soldiers will sometimes tape the bottoms of two magazines together so that when reloading is necessary, the two-magazine configuration need only be reversed to make the other of the two magazines available for seating in the magazine well of the rifle. Taping of magazines will reduce reloading time. However, this configuration is clearly awkward and makeshift, and if not taped securely, the two magazines can become separated.

Reducing reloading time can make the difference between life and death. Therefore, there remains a need for a way to quickly reload a combat rifle.

SUMMARY OF THE INVENTION

According to its general principles and briefly stated, the present invention is a device for holding plural, and preferably two, standard magazines so that either magazine can be inserted into the magazine well of a rifle for firing without the remaining magazine interfering with the first magazine or with the rifle. Furthermore, the magazines are held securely so that they remain in proper orientation during firing. The device comprises a shell and a centerpiece. The centerpiece snaps into the shell to lock the magazines tightly in place and snaps free of the shell when the magazines are to be removed.

The shell is symmetric so that the magazines can be placed into it either facing forward or facing backward. However, the centerpiece is not symmetric and requires that, whether the magazines are facing forward or backward, they must each be facing in the same direction. The advantage of this feature is that the holder need only be slightly shifted sideways to have the next magazine in the holder ready for inserting into the magazine well of the rifle.

The combination of the shell and the centerpiece holds the magazines at a preselected distance apart and at an angle wherein the tops of the magazines are farther apart than the bottoms, so that the tops do not interfere with either the rifle or its operation. The base of the shell is dimensioned to fit into the palm of a hand so that it can be grasped easily and securely. Furthermore, the present holder will hold magazines in position so that they can be inserted into either an M-16, M-4, or an M-249 without interfering with each other or with the gun.

In an alternative embodiment of the present invention, the magazines are held in the shell by a centerpiece; however, the magazines are not angled. In this embodiment, the base of the shell and distance between the bottoms of the magazines must be increased so that the distance between the tops of the magazines is sufficient to prevent one magazine from interfering with the firing of the other.

The combination of the choice of a light-weight polymer for the holder and holes formed in the holder is an important feature of the invention, because this combination makes the holder very light-weight, yet durable and able to hold the two magazines securely.

Other features and their advantages will be apparent to those skilled in the art from a careful reading of the Detailed Description of Preferred Embodiments accompanied by the following drawings.

BRIEF DESCRIPTION OF THE DRAWINGS

In the drawings,

FIG. 1 is an exploded, perspective view of a holder according to a preferred embodiment of the present invention;

FIG. 2 is perspective view of the holder of FIG. 1 with the centerpiece in place according to a preferred embodiment of the present invention;

FIG. 3 is an end cross sectional view of the holder showing two magazines in place according to a preferred embodiment of the present invention;

FIG. 4 is a top cross sectional view of the holder taken along line 4—4 in FIG. 3 showing two magazines in place according to a preferred embodiment of the present invention;

FIG. 5 is a side cross sectional view of the holder according to a preferred embodiment of the present invention;

DETAILED DESCRIPTION OF PREFERRED EMBODIMENTS

Figure 6:
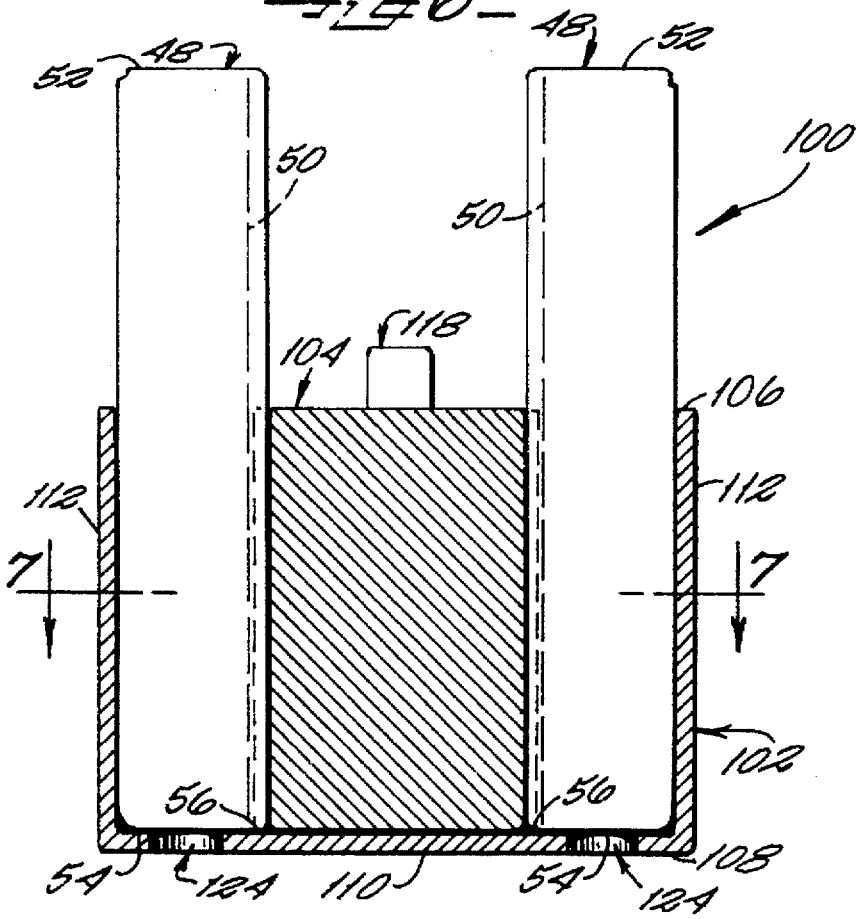
FIG. 6 is an end cross sectional view of the holder showing two magazines in place according to an alternative embodiment of the present invention.

Referring now to FIGS. 1–5, the present device is a two-piece polymer assembly. Preferably, the material of which it is made is a high-impact, corrosion-resistant and chemically-resistant nylon-base resin in a flat black or other suitable camouflage color. In particular, the material must be unaffected by standard firearm lubricants. The device, generally indicated by the reference number 10, includes a shell 12 and centerpiece 14. Shell 12 is symmetric left to right and front to back, open at the top 16, and is wider at top 16 than at the bottom 18. The floor 20 of shell 12 is peaked in the center so that, on either side of the peak 22, the floor 20 is perpendicular to the adjacent sidewall 24. Holes 26, 28 are formed in sidewalls 24 and floor 20, respectively, to reduce weight. There is a cutout portion 30 formed in each endwall 32 and which has a particular shape, the purpose of which will be described presently.

Centerpiece 14 is generally wedge-shaped, being narrower at the bottom 34 than at the top 36, and has a boss 38 on each side, closer to one end than the other. On each end 40 of centerpiece 14 is a flexible snap lock 42. Each snap lock 42 has a shoulder 44 and a finger grip 46, and is connected to centerpiece 14 on the extreme end of shoulder 44 so that finger grip 46 is cantilevered upwards and can flex freely. Snap locks 42 secure centerpiece 14 to shell 12 at cutout portions 30 when centerpiece 14 is pushed down into shell 12 far enough so that shoulders 44 snap into cutout portions 30 while finger grips 46 remain above top 16 of shell 12 (FIG. 5). By pressing on finger grip 46, or squeezing both finger grips 46 together simultaneously, snap locks 42 flex inwardly and shoulders 44 move out of cutout portions 30 so that centerpiece 14 can be lifted clear of shell 12.

Each standard issue magazine 48 has a trench 50 running from its top 52, where cartridges are inserted and withdrawn, to its bottom 54 (FIG. 3). Each boss 38 fits into a trench 50. At the bottom 54 of magazine 48 is a shelf 56 formed by the floor plate of the magazines. Bosses 38 seat onto this shelf 56 to prevent magazine 48 from coming out of device 10. Therefore, when the user of device 10 wants to put two magazines 48 into it, he first removes centerpiece 14, then places the two magazines 48 in against sidewalls 24 and facing the same direction so that their trenches 50 are oriented toward the same end of shell 12. Then centerpiece 14 is turned so that bosses 38 align with trenches 50 when centerpiece 14 is pushed between magazines 48. Centerpiece 14 is pushed into shell 12 between magazines 48, far enough so that snap locks 42 lock it into position. The dimensions of centerpiece 14 are such that there is an interference fit between magazines 48 and device 10 to add to the secure holding of the magazines in device 10.

Device 10 holds plural magazines 48, but preferably two magazines 48, in a "V" shape; that is, magazines 48 are closer together at bottom 18 of shell 12 than at top 16 of shell 12 to provide clearance under two circumstances. First, when the leftmost magazine 48 is engaged in the receiver of a gun and the ejection port of the receiver cover is closed, the angle between magazines 48 provides sufficient clearance so that when the first shot is fired, the ejection port cover can swing freely into the open position without striking the other magazine 48, which is in the ready position. Second, when the rightmost magazine 48 is in the receiver, the angle provides sufficient clearance for the operator to easily access the magazine release button on the receiver. Moreover, in addition to providing clearance for magazines 48, the V-shape makes the base of the device small enough to fit into the palm of the operator's hand so that it may be readily gripped for removal or insertion. Preferably, the angle A between the magazines should be not more than approximately 12°.

Figure 7:
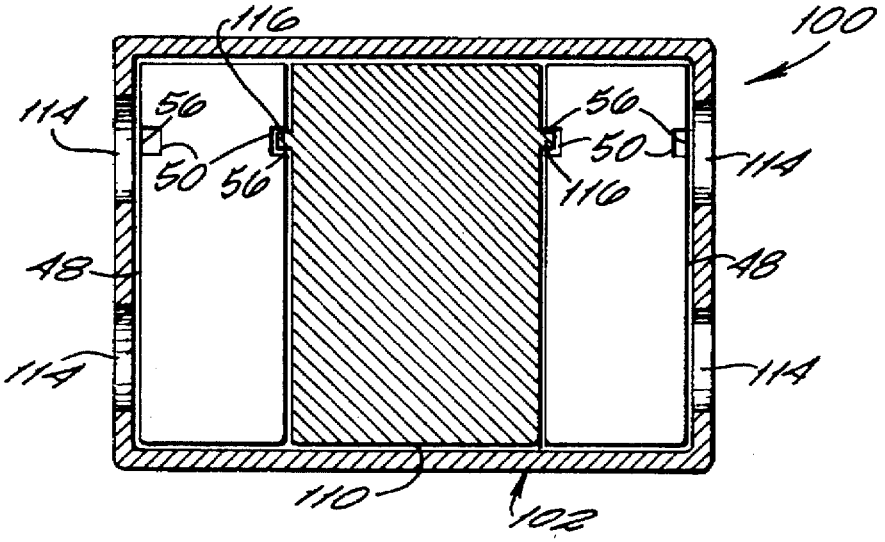
FIG. 7 is a top cross sectional view of the holder taken along line 7—7 in FIG. 6 showing two magazines in place according to an alternative embodiment of the present invention.

In an alternative embodiment of the present invention, as shown in FIGS. 6 and 7, the device 100 includes a shell 102 and a centerpiece 104. As in the preferred embodiment, shell 102 is symmetric left to right and front to back and open at the top 106. However, in an alternative embodiment, shell 102 is symmetric top 106 to bottom 108, and the floor 110 is generally flat, so that floor 110 is perpendicular to the adjacent sidewalls 112. As in the preferred embodiment, holes 114, 124 are formed in sidewalls 112 and floor 110, respectively, to reduce weight.

Centerpiece 104 is generally rectangular in shape, having a boss 116 on both sides, closer to one end than the other. As in the preferred embodiment, each end of centerpiece 104 has a flexible snap lock 118 that will engage a cut-out portion in shell 102 (not shown in FIGS. 6 or 7). Flexible snap locks 118 function the same as in the preferred embodiment, providing a convenient means for retaining and securing centerpiece 104 into shell 102.

Similar to the preferred embodiment, two magazines 48 are placed in shell 102 facing the same direction and oriented approximately parallel to each other. Then centerpiece 104 is turned so that its bosses 116 are oriented in the same direction as trenches 50 of magazines 48. Centerpiece 104 is pushed into shell 102, between magazines 48 far enough so that snap locks 118 lock it into position. As in the preferred embodiment, bosses 116 seat onto shelf 56 of magazines 48 to prevent magazines 48 from coming out of device 100. Furthermore, the dimensions of centerpiece 104 are such that there is an interference fit between magazines 48 and device 100, so that magazines 48 are securely held into place.

In this alternative embodiment, device 100 holds plural magazines 48, but preferably two magazines 48, in an approximately parallel position. It is necessary that the magazines 48 be spaced apart such that one magazine 48 does not interfere with the firing of the other magazine 48. This would occur in the two situations described in detail above. Consequently, it is necessary for the base of shell 102 to be bigger in this alternative embodiment than in the preferred embodiment. This is to allow the tops of the magazines 48 to have sufficient space therebetween so as not to interfere with the operation of a gun. Those of ordinary skill in the art will recognize that there may be other modifications to shell and centerpiece that will permit device 100 to function similarly without departing from the spirit and scope of the present invention.

It will be apparent to those skilled in the art that many substitutions and modifications can be made to the preferred embodiments described above without departing from the spirit and scope of the present invention.

What is claimed is:

1. An apparatus for holding a first magazine and a second magazine, each of said first magazine and said second magazine having a trench formed therein, said device comprising:

a shell;

a removable centerpiece having a pair of sides and a pair of ends, said centerpiece being wedge-shaped;

a boss formed on each of said pair of sides, said bosses positioned proximate to one of said ends of said centerpiece, said bosses of said centerpiece engaging said trenches of said first magazine and said second magazine when said first magazine and said second magazine are positioned within said shell.

2. The apparatus as recited in claim 1, wherein said shell has a pair of endwalls, each said pair of endwalls having a cut-out portion formed therein, and said centerpiece further comprising a pair of snap locks, said pair of snap locks engaging said cut-out portions of said shell when said centerpiece is positioned within said shell.

3. The apparatus as recited in claim 1, wherein said shell further comprises a floor and a pair of sidewalls extending therefrom, said sidewalls being approximately perpendicular to said floor.

4. The apparatus as recited in claim 1, wherein said first magazine and said second magazines have a shelf, so that when said first magazine and said second magazines are positioned within said shell and said centerpiece is positioned therebetween, said bosses engage said shelves of said first magazine and said second magazine.

5. The apparatus as recited in claim 1, wherein said centerpiece is rectangular.

6. The apparatus as recited in claim 1, wherein said shell has a floor with adjacent sidewalls, said floor having a peak formed therein defining sides, and each of said sides of said floor of said shell being approximately perpendicular to one of said adjacent sidewalls.

7. The apparatus as recited in claim 1, wherein said shell and said centerpiece cooperate to hold said first magazine and said second magazine within said shell, so that an angle is defined between said first magazine and said second magazine, said angle being less the twelve degrees, but greater than zero degrees.

8. The apparatus as recited in claim 5, wherein said shell and said centerpiece cooperate to hold said first magazine and said second magazine within said shell, so that said first magazine and said second magazine are in an approximately parallel position.

9. An apparatus for holding a plurality of magazines, said magazines having a trench and a shelf formed therein, said apparatus comprising:

a shell having a floor with adjacent sidewalls; and means for securing said plurality of magazines in said shell, said securing means engaging said trench and said shelf of each of said plurality of magazines.

10. The apparatus as recited in claim 9, wherein said floor of said shell has a peak forming a first side and a second side of said floor, said first side of said floor being approximately perpendicular to one of said adjacent sidewalls, and said second side of said floor being approximately perpendicular to the other of said adjacent sidewalls.

11. The apparatus as recited in claim 9, wherein said securing means further comprises:

a centerpiece having a pair of sides and a pair of ends;

a boss formed on each side of said pair of sides, said bosses positioned proximate to one end of said pair of ends of said centerpiece; and means carried by said centerpiece for retaining said centerpiece within said shell.

12. The apparatus as recited in claim 9, wherein said shell has at least one cut-out portion and said securing means further comprising means for engaging said cut-out portion.

13. The apparatus as recited in claim 9, wherein said securing means comprises a wedge-shaped centerpiece, said centerpiece securing each of said plurality of magazines within said shell, so that said plurality of magazines are oriented with an angle defined therebetween when in said shell, said angle being less than twelve degrees, but greater than zero degrees.

14. The apparatus as recited in claim 9, wherein said shell further comprises a pair of cut-out portions and said securing means further comprises a centerpiece having a pair of sides and a pair of ends; a pair of bosses formed on each of said pair of sides, said bosses positioned proximate to one end of said pair of ends of said centerpiece, said centerpiece having means for securing said centerpiece in said shell, said bosses engaging each of said trenches and said shelves of said plurality of magazines when said centerpiece and said plurality of magazines are positioned within said shell; and said securing means engaging said cut-out portions when said centerpiece is positioned within said shell.

15. An apparatus for holding a plurality of magazines, said magazines having a bottom, a trench, and a shelf, said apparatus comprising:

means for supporting said magazines from said bottom of said magazines so that said magazines are oriented in the same direction; and means for securing said plurality of magazines within said supporting means, said securing means removably positioned within said supporting means, said securing means further comprising a centerpiece having a pair of sides and a pair of ends, a boss formed on each side of said pair of sides, said bosses positioned proximate to one end of said pair of ends of said centerpiece, and means carried by said centerpiece for retaining said centerpiece within said supporting means.

16. The apparatus as recited in claim 15, wherein said supporting means further comprises:

a shell having a plurality of holes therethrough, said shell having a floor with adjacent sidewalls and endwalls, said endwalls having a cut-out portion formed therein, and said floor having a peak formed therein, each side of said peak in said floor being approximately perpendicular to said adjacent side wall.

17. The apparatus as recited in claim 15, wherein said supporting means further comprises:

a shell having a plurality of holes therethrough, said shell having a floor, sidewalls, and endwalls, said endwalls having a cut-out portion formed therein, said floor being approximately flat so that said floor is approximately perpendicular to said sidewalls.

18. The apparatus as recited in claim 15, wherein said retaining means retains said centerpiece within said supporting means so that said bosses engage each of said trenches and said shelves of said plurality of magazines, when said centerpiece is disposed between said plurality of magazines and positioned within said shell.

* * * * *